US005337224A

United States Patent [19]

Field et al.

[11] Patent Number: 5,337,224

[45] Date of Patent: Aug. 9, 1994

[54] ELECTROLUMINESCENT TRANSPARENCY ILLUMINATOR

[76] Inventors: John B. A. Field, 85 4th Ave., New York City, N.Y. 10003; Donald W. Stucke, Jr., 164 Pine St., Corning, N.Y. 14830

[21] Appl. No.: 985,900

[22] Filed: Dec. 4, 1992

[51] Int. Cl.[5] ..... F21V 9/16

[52] U.S. Cl. ..... 362/84; 362/98; 313/509; 40/367; 345/76

[58] Field of Search ..... 362/97, 98, 84; 340/781; 313/509; 315/169.3; 40/361, 362, 367

[56] References Cited

U.S. PATENT DOCUMENTS

| | | | |
|---|---|---|---|
| 2,972,674 | 2/1961 | Thornton, Jr. | 340/781 |
| 3,039,013 | 6/1962 | Wilmotte | 340/781 |
| 3,500,034 | 3/1970 | Bissell | 362/98 |
| 4,138,620 | 2/1979 | Dickson | 362/84 |
| 4,184,194 | 1/1980 | Shofu | 362/97 |
| 4,188,565 | 2/1980 | Mizukami et al. | 313/509 |
| 4,751,615 | 6/1988 | Abrams | 362/98 |
| 5,067,063 | 11/1991 | Granneman et al. | 362/84 |
| 5,153,386 | 10/1992 | Siefer et al. | 362/97 |

FOREIGN PATENT DOCUMENTS

| | | | |
|---|---|---|---|
| 0015502 | 1/1990 | Japan | 362/84 |

*Primary Examiner*—Richard A. Bertsch
*Assistant Examiner*—Michael I. Kocharov
*Attorney, Agent, or Firm*—Robert K. Tendler

[57] ABSTRACT

A compact portable transparency illuminator in the form of a thin light board includes a wafer-thin electroluminescent panel as the illuminating element, with the panel being no more than 1/32nd of an inch in thickness in one embodiment. In one embodiment, the panel is driven by an inverter or controller which converts battery power to 1,000–2,000 Hertz 120 volt AC. In general, the frequency at which the panel is driven is more than twice that normally utilized to drive electroluminescent panels in XY matrix displays to bring the color temperature of the light emitted to the 5,000–6,000 degree Kelvin range for true color viewing of the transparencies.

13 Claims, 4 Drawing Sheets

ELECTROLUMINESCENT TRANSPARENCY ILLUMINATOR

FIELD OF THE INVENTION

This invention relates to transparency illuminators and more particularly to a compact, thin, uniform illumination source for transparency viewing.

BACKGROUND OF THE INVENTION

In general, light boxes, light tables, and other illumination sources require the utilization of flourescent bulbs or incandescent bulbs. Flourescent lighting is indeed the preferred lighting vis-a-vis incandescent lighting, due to lower operating temperatures and the ability to obtain a white light having a neutral white color, as measured in degrees Kelvin of between 5,000° and 6,000° K. This light, in combination with the emulsions, dyes and pigments utilized in color photography, provide for the most natural presentation of the images on the film transparency. Thus, while white light in the 5,000° to 6,000° K. range is not truly neutral white light, it provides for apparent true color viewing of a color transparency.

While film transparencies have been used in the photographic, medical and visual art fields for reasons ranging from diagnosis and evaluation to display and presentation, light boxes and light tables used to view the transparencies have a number of serious drawbacks due to the utilization of flourescent tubes. First, these tubes require substantial amounts of power, with ballast, grounding and heat dissipation adding substantial weight to the light box. Moreover, the tubes are breakable and the flourescent gas is hazardous.

More importantly, current light boxes are not compact and must have substantial thickness to allow for diffusers to provide uniform light distribution. This is because flourescent bulbs can be considered to be line sources of light. Thus, for multiple tubes, there are areas or lines of illumination interspersed with lines of darkness. In order to overcome this serious drawback, complicated and bulky diffusers are utilized to spread the light. Additionally, in efforts to miniaturize flourescent tubing-type light boxes, the uniform quality of the light is sacrificed.

In point of fact, rarely is a light box found that is under two inches in thickness. This is a problem in the presentation of film and x-ray transparencies due to size and weight of the light box. Most of the weight of the box is due to the excessive power requirements for flourescent tubes, making battery-powered units impractical.

Moreover, if flourescent light boxes are to be mounted to a wall, there must be a way of providing power from a wall socket to the display or light box, which is both inconvenient and often times impossible at various locations. Also, it will be appreciated that any light box which heats up causes changes in the dimensional stability of the film on the light box or light table. Additionally, for those light boxes employing flourescent tubes, there is always the problem of flexibility and breakage, and also the problem of the release of hazardous gas carried within the flourescent tube envelope.

Another extremely pressing problem is one of flicker which occurs in all flourescent tube applications. This flicker while it is just under that which is visually perceptible is indeed annoying. Also, flicker has an effect on the eyes and their receptors, making transparency viewing tiring.

Another problem, is that there is a significant warm-up time for the flourescent bulbs, along with an excessive initial current draw, and unstable color output, lasting sometimes as long as one half hour after warm-up.

This being the case, there is a need for a compact, portable, transportably transparency illuminator which first and foremost produces uniform illumination across a planar surface at the appropriate color of between 5,000 and 6,000 Kelvin. Moreover, the light source must not only be perceptibly flicker-free and uniform at the appropriate color, it must also completely eliminate the use of flourescent tubes and their attendant problems.

SUMMARY OF THE INVENTION

In order to provide a compact, portable transparency illumination device, whether or not battery-powered, a thin light board is provided for the illumination of transparencies, be they color transparencies or black and white transparencies, in which an electroluminescent illuminator panel is used as the illumination source. Rather than being driven at its usual excitation frequency of 700 Hertz, the panel is driven at between 1,000 and 2,000 Hertz. This shifts the output from the illumination panel down from 9,000 degrees Kelvin to below 6,000 degrees Kelvin. It is important to have the illumination in this particular neutral white range to present transparencies in their best light for natural color presentation. Note that while neutral white is around 3500° K., natural light viewing of the transparencies requires light around 5,000–6,000 degrees Kelvin.

While conventional electroluminescent light sources for XY addressable displays and the like are driven typically at around 700 Hertz, it is the finding of this invention that the driving of these same electroluminescent panels at 1,000–2,000 Hertz shifts the output to the desired region. Also, the use of an electroluminescent panel and its low power consumption permits battery operation and thus compactness and portability.

To provide a suitable panel, the usual XY addressable transparent matrix on top of a conventional electroluminescent panel is eliminated. A sandwich structure is the result in which there is a planar metal electrode on the bottom of the panel, followed by a dielectric layer, which is in turn followed by a layer of electroluminescent phosphors. The phosphor-containing layer is covered by a further dielectric layer and a transparent planar. This combination is laminated together to form either a flexible or rigid transparency illuminator which is wafer thin and which has a thickness under 1/32nd of an inch in one embodiment.

The driving of the panel with 120 volt AC at 1,000 to 2,000 Hertz, shifts the panel output towards neutral white and has extremely low current draw, with no warm-up. Moreover, there are no diffusers or ballast involved; and with the low current drain the display can be driven continuously for an extended period of time.

In one embodiment, a battery compartment is provided for the light board at one of the long edges of the board. The compartment is tubular in nature to accommodate conventional C-cells and rechargeable batteries and is integrally formed with the edge to provide an ergonomic hand grip for use in holding the light board while viewing the transparencies. Additionally, the battery compartment when placed at the top edge of the light board provides that the light board rest at a convenient angle, nominally 15°, so that the light board can be placed on a desk and the transparencies viewed by a person sitting at the desk. Moreover, in one embodiment, an integral hinged stand is provided for propping up the board at a more steep angle, with the stand folding back into the housing of the light board at its rear.

While the electroluminescent panel is usually rigid, the panel can be made flexible to permit a cylindrical configuration for a kiosk-type display in which the transparencies which are illuminated from behind via the subject electroluminescent panel flexed onto a solid cylinder.

In summary, a transparency illuminator in the form of a light board includes the utilization of an electroluminescent panel as the light source, with the panel being a wafer thin laminate. The panel is driven by 1,000–2,000 Hertz 120 volt AC. In one embodiment, the frequency at which the panel is driven is more than twice that normally utilized to drive electroluminescent panels in XY addressable matrices in order to bring the color temperature of the light emitted to the 5,000–6,000 degree Kelvin range Note that both battery operation and AC power operation are within the scope of this invention.

The resulting transparency illuminator is a lightweight, truly portable light board, with uniform illumination and small size that replaces the flourescent bulb-type illuminators which are breakable, hazardous, and bulky. In battery operated models, the battery compartment is at one edge of the light board to form a convenient grip or handle in one embodiment, while also forming a stand to tilt the light board when the light board is placed on a desktop. Moreover, the compact wafer-like construction of the light board permits easy storage and flexibility such that the electroluminescent transparency illuminator may, for instance, be formed in a cylinder with transparencies displayed as on a cylindrical column or rolled up in a tube for easy storage. Additionally, due to the utilization of an electroluminescent panel with inherent low power requirements, the power requirements for a transparency illuminator are significantly reduced over those associated with flourescent light panels. Most importantly, the of light from the electroluminescent panel is much more uniform than the line sources associated with flourescent display tubes.

BRIEF DESCRIPTION OF THE DRAWINGS

These and other features of the Subject Invention will be better understood taken in conjunction with the Detailed Description and the Drawings of which.

DETAILED DESCRIPTION

Figure 1A:
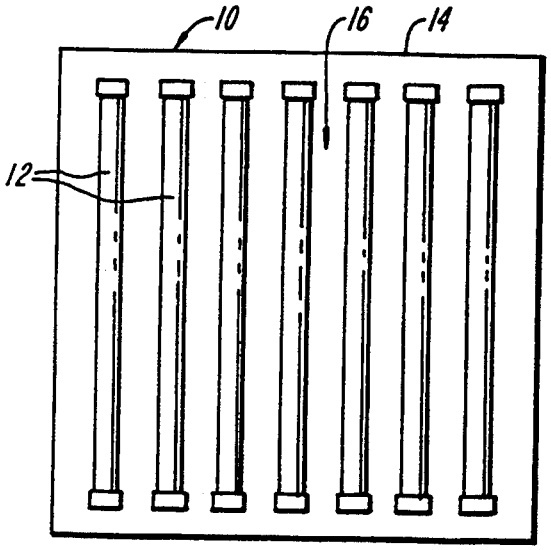
FIG. 1A (PRIOR ART)
FIG. 1A is a diagrammatic representation of a prior art light box indicating the utilization of longitudinal flourescent elements.

Referring now to FIG. 1A, a conventional light box 10 is illustrated as having straight longitudinally running flourescent elements 12 within a box 14. It will be appreciated that these elements are tubes which form line sources, the output of which must be distributed or spread across the extent 16 of the light box.

Figure 1B:
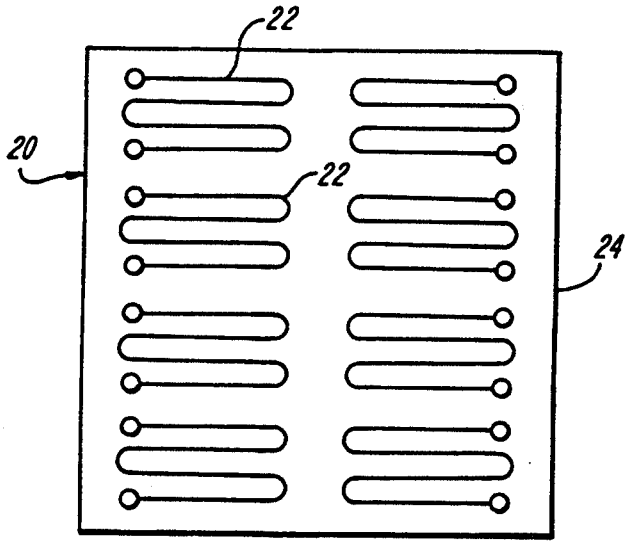
FIG. 1B (PRIOR ART)
FIG. 1B is a diagrammatic representation of a more modern flourescent tube light box illustrating a serpentine series of flourescent elements therein.

In an effort to overcome the line source problem of alternating light and dark areas associated with the light box of FIG. 1A and referring now to FIG. 1B, a light box 20 is illustrated as having serpentine flourescent tubes 22 located within a box 24. While this arrangement of flourescent tubes provides more uniform light from the light box, it nonetheless suffers from the weight and bulk of utilizing flourescent tubes and nonetheless requires thickness for diffusion.

Figure 1C:
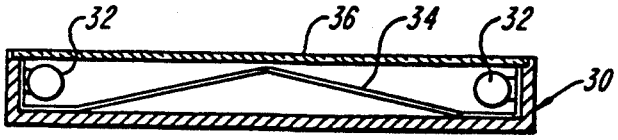
FIG. 1C (PRIOR ART)
FIG. 1C is a cross-sectional diagrammatic representation of the utilization of one prior art type complex multifaceted diffuser with flourescent elements to create a uniformly distributed light.

Referring now to FIG. 1C, as to diffusers, typically a light box 30 is provided with longitudinally running flourescent tubes 32, with a diffuser 34 located between adjacent tubes to provide uniformly distributed light. These diffusers are quite complicated, costly and heavy and are sometimes made of fragile plastic, thereby detracting from the portability and convenience of the light box. Additionally, a face plate 36 may have to be frosted or provided with diffusing elements to assist in the distribution of the light from what are essentially line sources.

Figure 2A:
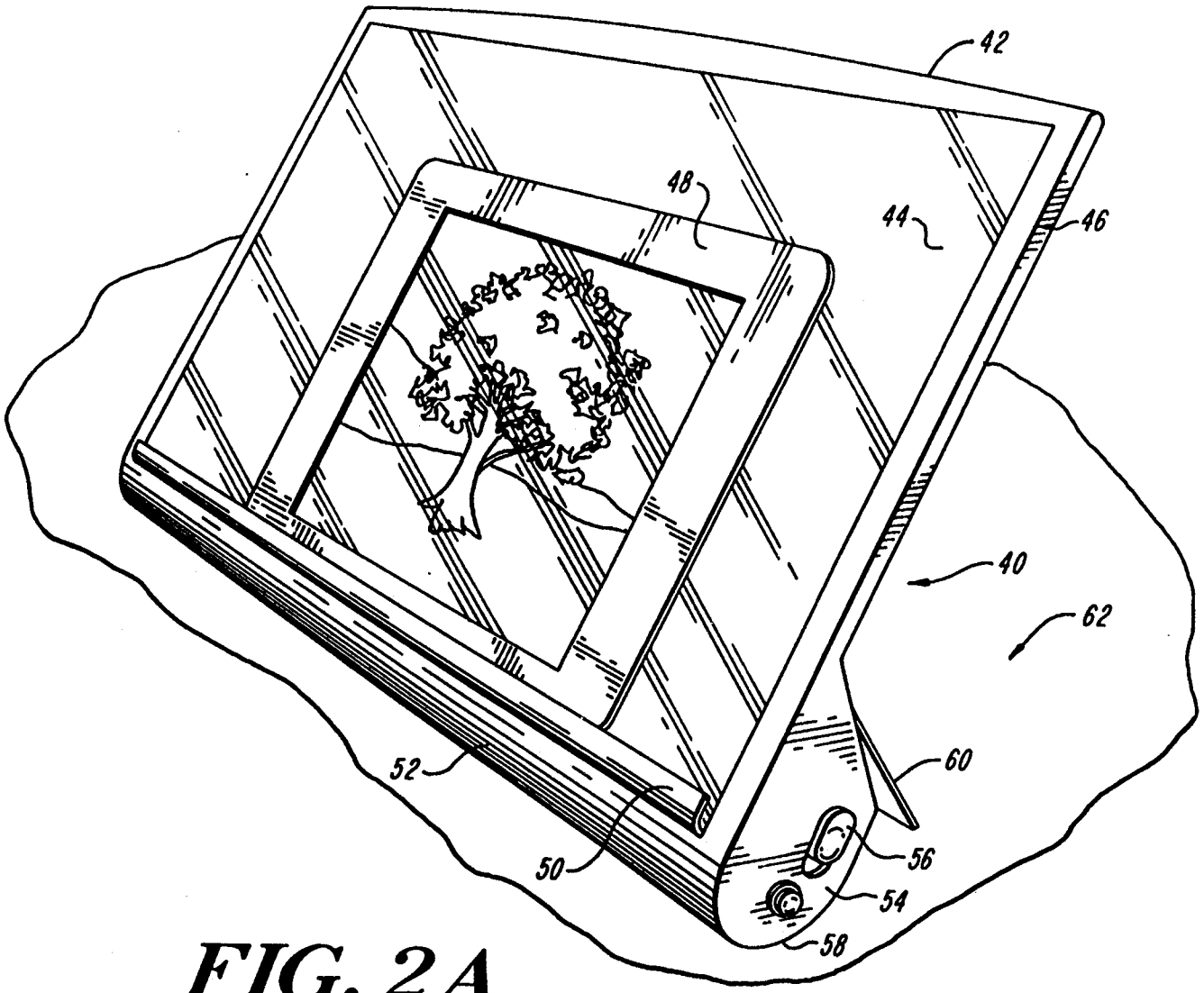
FIG. 2A is a diagrammatic representation of the Subject transparency illuminator illustrating a battery-powered configuration having a wafer-thin light board incorporating an electroluminescent illuminator panel.

Referring now to FIG. 2A, in order to obviate the problems with flourescent tube light boxes, in the Subject System a transparency illuminator 40 is configured as a thin light board 42 having a top surface 44 corresponding to the top surface of an electroluminescent illuminator panel embedded within a light board frame 46. As can be seen, a transparency 48 is provided on top of surface 44 and, in one embodiment, is held in place via a channeled lip 50 at the base 52 of the transparency illuminator. Incorporated into base 52 is a battery compartment 54 with an on/off switch 56. Note that the battery compartment is rounded at the base as shown at 58 to provide a hand grip for the transparency illuminator. Also shown in this figure is a stand 60 which is pivoted outwardly from frame 46 to prop up the transparency illuminator when placed on a desk top 62.

Figure 2B:
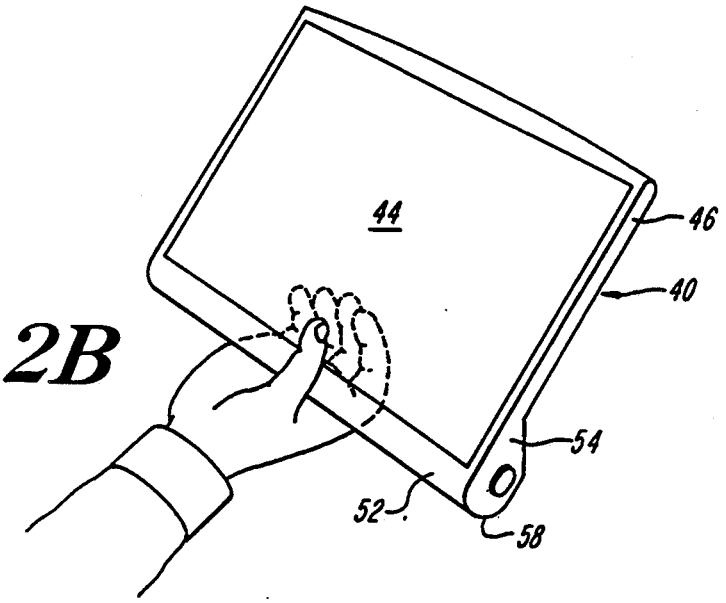
FIG. 2B is a diagrammatic representation of the transparency illuminator of FIG. 2A illustrating holding the illuminator panel by its battery compartment at the base thereof.

Referring now to FIG. 2B, transparency illuminator 40 may be gripped from its base 52 as illustrated due to the rounded surface 58 of battery compartment 54 which makes the Subject transparency illuminator a convenient, light weight hand held device which is easily portable. It will be noted that in one embodiment, rechargeable batteries may be placed in the battery compartment to drive the electroluminescent panel forming the illuminating element for the transparency illuminator.

Figure 2C:
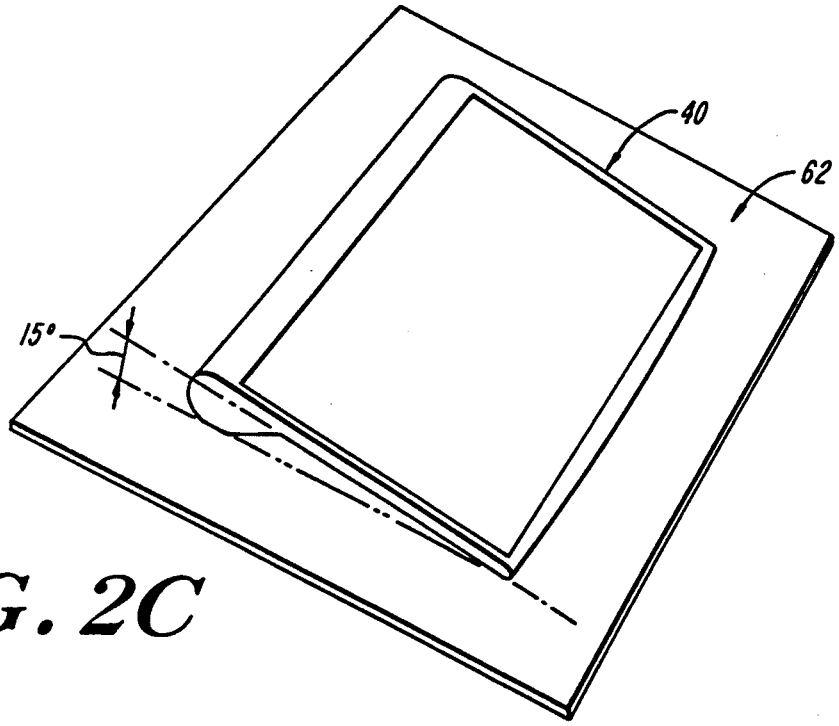
FIG. 2C is a diagrammatic representation of the transparency illuminator of FIG. 2A positioned for viewing on a table.

Referring now to FIG. 2C, it will be appreciated that transparency illuminator 40 may be placed on a table top 62 in an upside-down inverted fashion, such that battery compartment 54 serves to tilt the transparency illuminator at a nominal 15° with respect to the surface of the table. Thus, rather than utilizing the tab 60 associated with the FIG. 2A embodiment, the illuminator can be inverted and utilized on a table top to provide a convenient viewing angle for a person looking down at the transparency illuminator.

Figure 3:
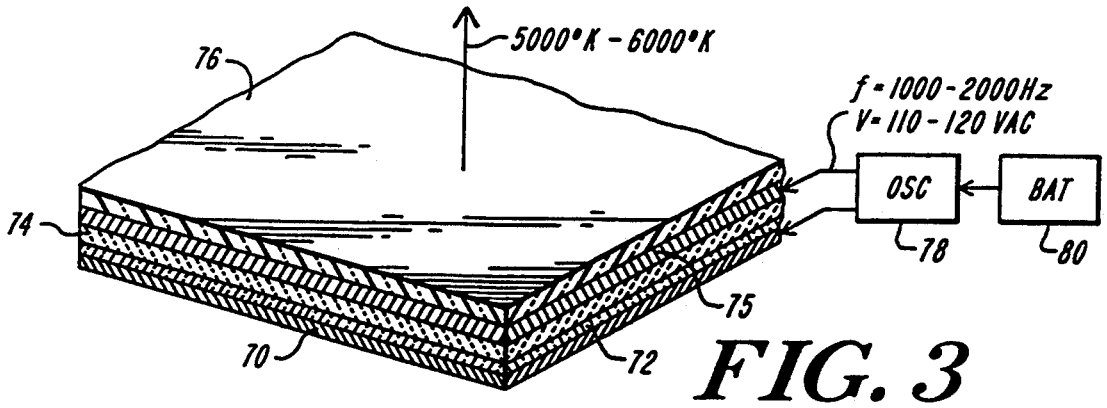
FIG. 3 is a cross-sectional and diagrammatic representation of a layered and laminated electroluminescent panel suitable for use in the transparency illuminator FIGS. 2A, 2B and 2C.

Referring now to FIG. 3, the laminated electroluminescent panel which forms the illumination source for the transparency illuminator includes a conductive layer 70 over top of which is placed a dielectric layer 72. On top of the dielectric layer is placed a phosphorous bearing layer 74. It will be appreciated that premade electroluminescent panels of a suitable configuration are manufactured by NEC as the Film Supertwist White 5LF panel, by Quantex as the Perma White panel, by Durell, and by others utilizing blue and green phosphors, and with phosphors by GTE in conjunction with a magnesium chromate dye number 6. A clear dielectric layer 75 is provided on top of the phosphor carrying layer, with a transparent conductive layer 76 on top of dielectric layer 75.

When driven by oscillator 78 having its output applied across conductive layers 70 and 76, the output from the laminated sandwich panel is between 5,000° K. and 6,000° K. for a drive voltage of 110–120 volts at a frequency of 1,000–2,000 Hertz.

It is noted that when driving the electroluminescent panel in the above manner, not only is the output of the phosphorous-bearing layer shifted towards 5,000° K. neutral white, the efficiency of the system is such that a battery 80 may be used to power the light board.

Figure 4:
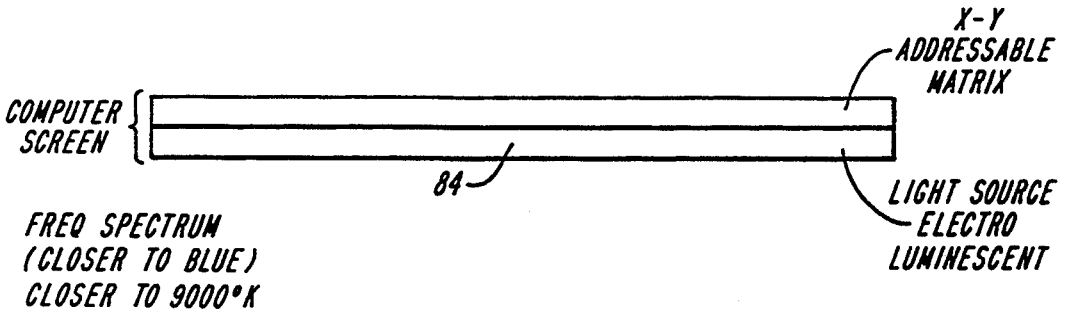
FIG. 4 (PRIOR ART)
FIG. 4 is a diagrammatic representation of a prior art electroluminescent display having an XY addressable matrix thereon, with an output therefrom in the blue portion of the spectrum close to 9,000° K.

Referring now to FIG. 4, conventional electroluminescent displays include an electroluminescent light source 84, with an XY addressable matrix 86 on top. These electroluminescent displays are usually driven at about 700 Hertz, which results in a frequency spectrum from the electroluminescent display closer to the blue, e.g., closer to 9,000° K.

Figure 5:
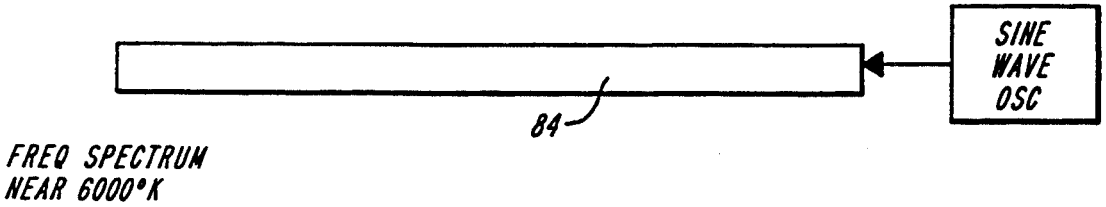
FIG. 5 is a diagrammatic representation of the electroluminescent panel utilized in the Subject Invention in which the electroluminescent panel is devoid of an XY addressable matrix on the top thereof, and having an output below 6,000° K.; and, FIG. 6 is a diagrammatic representation of the Subject transparency illuminator configured in a cylindrical form in which the electroluminescent panel is flexible and is bent about a cylinder, over the top of which a transparency may be placed for illumination from the rear thereof.

On the other hand, and referring now to FIG. 5, taking the electroluminescent display of 84, and removing the XY addressable display matrix, along with driving the display at twice the normal frequency, the output from the display is more uniform and, with the frequency spectrum of the output shifted towards neutral white, the output is now below 6,000° K. for more natural viewing of color transparencies.

Figure 6:
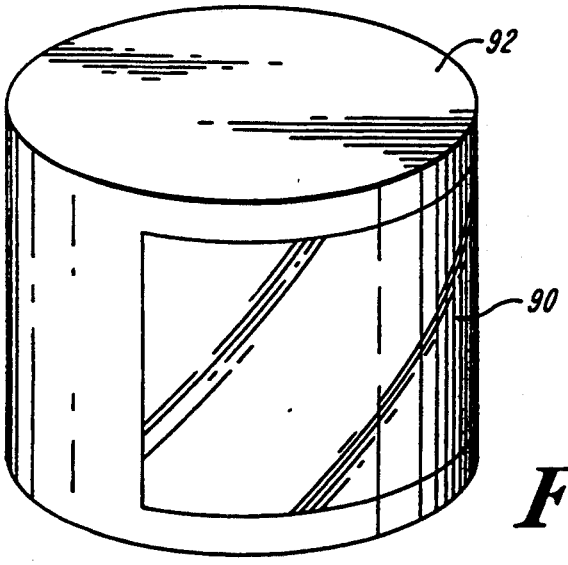

Referring now to FIG. 6, it will be appreciated that the electroluminescent panel can be made flexible such that the flexible panel 90 can be mounted to a cylindrical support 92 to provide a cylindrical illumination source over which a large color transparency can be mounted. This provides a kiosk-type illumination system for transparencies to provide a convenient display.

Having above indicated a preferred embodiment of the present invention, it will occur to those skilled in the art that modifications and alternatives can be practiced within the spirit of the invention. It is accordingly intended to define the scope of the invention only as indicated in the following claims.

We claim:

1. Apparatus for illuminating transparencies for true color viewing thereof, comprising:

an electroluminescent panel producing white light in a color temperature range above 3,500° K., said panel adapted to emit light from a top surface thereof through a color transparency adjacent the top surface of said panel; and, means for driving said electroluminescent panel with a constant frequency and voltage signal, said frequency being at 1000–2000 Hz to provide suitable stable natural white light for color transparency evaluation by driving said electroluminescent panel so as to maintain the light output thereof between 3,500 and 6,000° K., whereby said light is projected through said transparency for true color viewing thereof.

2. The Apparatus of claim 1, wherein said driving means includes means for applying an alternating current across said illuminating panel at a frequency of between 1,000 and 2,000 Hertz.

3. The Apparatus of claim 1, and further including a housing, means for mounting said panel in said housing to expose a top surface thereof, and means at an edge of said housing for carrying batteries for the powering of said panel.

4. The Apparatus of claim 3, wherein that portion of the housing surrounding said panel is wafer-thin in size.

5. The Apparatus of claim 1, wherein said panel is rigid.

6. The Apparatus of claim 1, wherein said panel is flexible.

7. The Apparatus of claim 6, and further including means for mounting said flexible panel to a cylindrical surface for providing a cylindrical display.

8. The Apparatus of claim 1, and further including a battery, and wherein said driving means includes means for converting the direct current output of said battery to alternating current at a frequency of between 1,000 and 2,000 Hertz.

9. The Apparatus of claim 1, wherein said panel is a laminate, including, in order from the bottom, a first conductive layer, a first dielectric layer, a layer containing phosphors, a second dielectric layer, and a transparent top conductive layer.

10. The Apparatus of claim 9, wherein said phosphors are taken from the group consisting of blue phosphors, green phosphors and magnesium chromate dye.

11. A compact, thin, lightweight color transparency illuminator, comprising:

a light board adapted to emit stable natural white light through a color transparency, said light board including an electroluminescent panel producing white light in a color temperature range above 3,500° K. having a top light emitting surface at one surface of said board; and, means for driving said electroluminescent panel with a constant frequency and voltage signal, said frequency being at 1000–2000 Hz to produce uniform stable natural white light maintained at or below 6,000° K. across said top light emitting surface to permit true color evaluation of color transparencies.

12. The transparency illuminator of claim 11, wherein said light board includes a battery compartment at one edge thereof for carrying batteries to power said electroluminescent panel, said compartment having a smooth rounded outer surface for providing a convenient ergonometric hand gripping area for manual support of said light board and for providing a standoff for the tilting of said board when said light board is placed on a flat surface.

13. A color transparency illuminator comprising an electroluminescent panel emitting natural white light having a color temperature about 3,500° K. from a surface thereof through a transparency adjacent said surface and means for driving said panel with a constant frequency and voltage signal, said frequency being at 1000–2000 Hz to guarantee a stable uniform light output at or less than 6,000° K. across a surface thereof, thus to permit true color evaluation of said color transparency.

* * * * *